US007042473B2

(12) United States Patent
Lehtonen

(10) Patent No.: US 7,042,473 B2
(45) Date of Patent: May 9, 2006

(54) METHOD AND SYSTEM FOR DISPLAYING MARKUP LANGUAGE BASED PAGES ON HANDHELD DEVICES

(75) Inventor: Arto Lehtonen, Tampere (FI)

(73) Assignee: Nokia Mobile Phones, Ltd., Espoo (FI)

( * ) Notice: Subject to any disclaimer, the term of this patent is extended or adjusted under 35 U.S.C. 154(b) by 520 days.

(21) Appl. No.: 09/892,669

(22) Filed: Jun. 27, 2001

(65) Prior Publication Data

US 2002/0000991 A1 Jan. 3, 2002

(30) Foreign Application Priority Data

Jun. 30, 2000 (FI) ..... 20001573

(51) Int. Cl.
*G09G 5/00* (2006.01)

(52) U.S. Cl. ..... 345/660

(58) Field of Classification Search ..... 345/670, 345/660, 603, 801, 864; 455/566; 382/298, 382/299; 348/581; 714/4; 715/801, 864, 715/760

See application file for complete search history.

(56) References Cited

U.S. PATENT DOCUMENTS 4,610,026 A * 9/1986 Tabata et al. ..... 382/300
5,025,315 A * 6/1991 Johary et al. ..... 348/441
5,138,454 A * 8/1992 Parulski ..... 348/581
5,196,934 A * 3/1993 Fleischman et al. ..... 348/581
5,283,651 A * 2/1994 Ishizuka ..... 348/704
5,353,067 A * 10/1994 Kaji ..... 348/568
5,638,467 A * 6/1997 Chua et al. ..... 382/298
5,727,159 A 3/1998 Kikinis ..... 395/200.76
RE36,145 E * 3/1999 DeAguiar et al. ..... 345/538
5,909,540 A * 6/1999 Carter et al. ..... 714/4
5,923,738 A 7/1999 Cardillo, IV et al. .... 379/93.25
6,037,926 A * 3/2000 Haas et al. ..... 345/603
6,076,109 A 6/2000 Kikinis ..... 709/228

(Continued)

FOREIGN PATENT DOCUMENTS

WO WO 98/36344 8/1998

OTHER PUBLICATIONS

"Digestor: Device-independent Access to the World Wide Web". Bickmore et al., Proc. 6th Intl. World Wide Web Conf., 1997, 10 page document.

(Continued)

*Primary Examiner*—Ryan Yang
(74) *Attorney, Agent, or Firm*—Perman & Green, LLP.

(57) ABSTRACT

A method and system for displaying an markup language based Web page on a handheld device having a relatively small display is disclosed. The method includes loading a Web page designed for viewing in, for example, SVGA resolution. The page is stored in a virtual memory (204) in the device in the form of horizontal and vertical pixels. The horizontal and vertical pixels are read from the virtual memory (204) in separate horizontal pixel and vertical pixel bit streams. The horizontal pixel bit stream is fed through a horizontal pixel counter (206) that flag certain pixels for removal by a horizontal pixel filter (207). Similarly, the vertical pixel bit stream is fed through a vertical pixel counter (208) that flag certain pixels for removal by a vertical pixel filter (209). The remaining pixels are stored in a display memory (210) and are presented on the handheld device display (212).

11 Claims, 3 Drawing Sheets

U.S. PATENT DOCUMENTS

| | | | | |
|---|---|---|---|---|
| 6,100,870 | A * | 8/2000 | Ohara | 345/670 |
| 6,141,061 | A * | 10/2000 | Takeuchi | 348/581 |
| 6,185,625 | B1 * | 2/2001 | Tso et al. | 709/247 |
| 6,262,708 | B1 * | 7/2001 | Chu | 345/667 |
| 6,311,197 | B1 * | 10/2001 | Mighdoll et al. | 715/513 |
| 6,312,276 | B1 * | 11/2001 | Lin | 439/342 |
| 6,392,701 | B1 * | 5/2002 | Akeyama et al. | 345/670 |
| 6,417,889 | B1 * | 7/2002 | Numata | 348/581 |
| 6,633,314 | B1 * | 10/2003 | Tuli | 345/744 |
| 2002/0129382 | A1 * | 9/2002 | Zhao et al. | 725/137 |

OTHER PUBLICATIONS

"Formative Evaluation of Flip Zooming: Towards Effective Integration of Detail and Context on Small Display", Holmquist et al., Viktoria Research Report, VRR-98-1, 10 page document.

"WEST : A Web Browser For Small Terminals", Bjork et al., ACM Symposium on User Interface Software and Technology, 1999, 10 page document.

* cited by examiner

METHOD AND SYSTEM FOR DISPLAYING MARKUP LANGUAGE BASED PAGES ON HANDHELD DEVICES

FIELD OF INVENTION

The present invention relates generally to handheld devices and, more particularly, to a technique for downloading mark up language based pages designed for larger displays for view on handheld devices having relatively small displays.

BACKGROUND OF THE INVENTION

The Internet and that portion of the Internet comprising the World Wide Web (WWW or Web) has proven to be a useful and effective way for people to access vast amounts of information quickly and conveniently. Accordingly, Internet content and the number of services provided thereon have increased dramatically and is projected to continue to do so for many years. As the Internet becomes increasingly prevalent throughout the world, more and more people are coming to rely on the medium as a necessary part of their daily lives. Presently, the majority of people typically access the Web with a personal computer (PC) using a browser such as Netscape Navigator™ or Microsoft Internet Explorer™, for example. Consequently, the vast majority of Web sites are written in hypertext markup language (HTML) which are designed to be viewed on the full size displays of desktop PCs.

Given that the Web is becoming increasingly indispensable to many people, there is a growing need to be able to access online resources at anytime and from anywhere. A new generation of handheld devices have appeared on the market (or are currently in development) to fulfill this demand. The fast pace of technological development have led to dramatic increases in processing power, memory capacity and the like that make handheld devices particularly suitable for use in accessing the Web while on the move. The term handheld devices is used herein to refer to any portable device such as handheld computers, personal digital assistants (PDAs), and communicator devices such as the Nokia 9110 Communicator and its successors, in addition to mobile phones. Although wireless Web access holds high promise in terms of productivity and convenience, there are notable factors that make Web browsing with handheld devices difficult. For example, these devices typically have small displays, limited processing power and memory, limited input facilities as compared to desktop PCs.

The small displays of handheld devices are designed to facilitate portability which lend to a small footprint that can be easily carried in a shirt pocket, for example. The relatively small displays of handheld devices poses a particular problem when viewing Web pages that are commonly designed for viewing on full size desktop computer displays. By way of example, many Web pages are designed to be viewed at a resolution of at least SVGA i.e. 800×600 pixels or above (horizontal by vertical resolution), which when displayed on a handheld computing device with a resolution of e.g. 160×160 pixels (typical for PDA devices) results in viewing only a small portion of the page. The problem is particularly acute in mobile phones because of their disproportionately small displays that are typically only capable of displaying 2–6 lines of text with limited graphics capabilities. Thus, attempting to view and navigate a Web page on a handheld device can be onerously difficult.

There have been a number of methods proposed for viewing and navigating Web-based data on handheld devices. One method is to design the Web page to work on all display sizes independent of the particular device. This could be done by displaying only essential data from the page and possibly using some sort of predictive navigation technique where the browsing history is used to display links that the user would likely follow. In practice this technique of filtering content does not work effectively for many users since some data deemed important by a user may have been eliminated. Additionally, the method is limited in the types of pages that can be displayed because Web pages comprising a large proportion of graphics are not easily reduced by these filtering techniques. Another method is design several versions of Web pages for display on various devices. This is achieved by detecting the particular device used, e.g. when a sync operation is made with the HTTP server, the appropriate page best suited for display on the device is then downloaded. A disadvantage of this is that several versions of the page must be created to conform to the many types of devices that may access it which must be continually updated for new devices.

In view of the foregoing, it would be desirable to provide a method which would enable original Web pages to be displayed on handheld devices.

SUMMARY OF THE INVENTION

Briefly described and in accordance with an embodiment and related features thereof, in a method aspect there is provided a method of displaying markup language based Web page on a handheld device, wherein the handheld device comprises a browser, a virtual memory functionally connected to a horizontal pixel counter and a horizontal pixel filter and to a vertical pixel counter and a vertical pixel filter, a display memory functionally connected to the horizontal pixel filter and to the vertical pixel filter, and a display functionally connected to the display memory, the method comprising the steps of:

loading said Web page into the virtual memory;

reading from the virtual memory a bit stream of horizontal pixels and a bit stream of vertical pixels, and feeding the bit streams to the horizontal pixel counter and the vertical pixel counter respectively;

counting the horizontal pixels from the horizontal bit stream with the horizontal pixel counter and removing a portion of the horizontal pixels with the horizontal pixel filter;

counting the vertical pixels from the vertical bit stream with the vertical pixel counter and removing a portion of the vertical pixels with the vertical pixel filter;

storing the remaining horizontal and vertical pixels in the display memory; and displaying the Web page from the display memory.

In an apparatus aspect, there is provided a handheld device comprising a browser for use in loading a markup language based Web page, a display memory, and a device display for viewing the Web page, is characterized in that the handheld device further comprises:

a virtual memory for storing the loaded Web page comprised of horizontal and vertical pixels, a horizontal pixel counter for counting pixels read from the virtual memory in a horizontal bit stream;

a horizontal pixel filter for removing pixels from the horizontal pixel bit stream;

a vertical pixel counter for counting pixels read from the virtual memory in a vertical bit stream; and a vertical pixel filter for removing pixels from the vertical pixel bit stream, whereby the remaining pixels from the horizontal and vertical bit streams are stored in said display memory for viewing on the device display.

BRIEF DESCRIPTION OF THE DRAWINGS

The invention, together with further objectives and advantages thereof, may best be understood by reference to the following description taken in conjunction with the accompanying drawings in which.

DETAILED DESCRIPTION OF THE INVENTION

The technical process of viewing an HTML Web page is relatively simple. There are three basic components that are required in order to view Web pages on any device i.e. a Web page, a Web browser, and a Web server. First, the Web page itself is required to exist in order for it to be look at. The Web page basically consists of a relatively simple text file that contains text together with a set of HTML tags that describes how the page will be formatted on a display screen by a Web browser. The Web browser is a software application running on the device that is able to send requests in order to locate the Web page (typically on the internet or intranet) and interpret the set of HTML tags from the returned HTML file that indicate the format and structure of the page to be displayed. The Web server is typically a computer host on the internet that responds to the Web browser's request for the page and sends the page to the browser. Other relevant components include routers, nodes, proxies etc. which are well known to those skilled in the art and are not discussed further herein.

Figure 1:
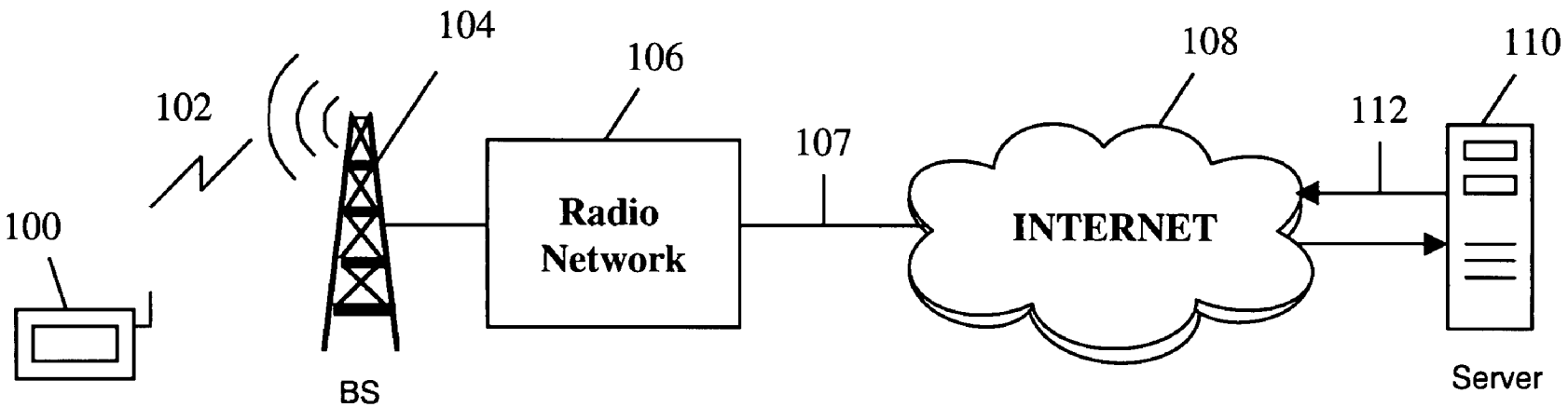
FIG. 1 illustrates an exemplary download procedure for a Web page over a wireless radio network.

FIG. 1 illustrates a typical procedure in which a wireless handheld device downloads an exemplary Web page. A wireless handheld device 100 sends a request for a Web page that includes its universal resource locator (URL). The request is sent via a radio link 102 to a base station 104 associated with a radio telecommunication network 106. The request is passed through the radio network 106 to the Internet 108 via a high speed link 107. The request is routed to a Web server 110 connected to the Internet via links 112, which responds by sending the Web page specified by the URL. The Web page travels a reverse route back to the device 110 i.e. via the Internet 108, through the radio network 106, to the base station 104 and finally to device 100 via the radio link 102.

As mentioned in the preceding sections, there are inherent difficulties in viewing Web pages on handheld devices having relatively small displays. Content designed for full size displays are generally ill-suited for viewing on small screens. In accordance with an embodiment of the present invention, a method and system for suitably resizing a Web page such that it can be properly viewed by a Web browser running on a handheld device is described.

In accordance with an embodiment of the present invention, a wireless handheld device such as a communicator device (e.g. a successive generation to the Nokia 9110 Communicator) generally possesses much improved resolution relative to current generation devices i.e. approximately 640×300 pixels. The trend in successive generations of handheld devices is toward increasing resolution that start to approach that of VGA (640×480), making viewing Web pages far more feasible and practicable. By way of example, an HTML Web page, originally designed for display in SVGA i.e. resolution of 800×600, is downloaded and stored into a virtual memory adapted to receive the page in 800×450 in the virtual memory in the handheld device. The stored vertical resolution of 450 instead of 600 is not a problem since scrolling can be done to view the remaining portion. The HTML page is then resized for suitable display in its entirety on the device in a perspective similar to that when viewed on a full size display and without undue distortion. This is performed by the systematic elimination of pixels while transferring them to a display memory which are then sent to the display.

Figure 2:
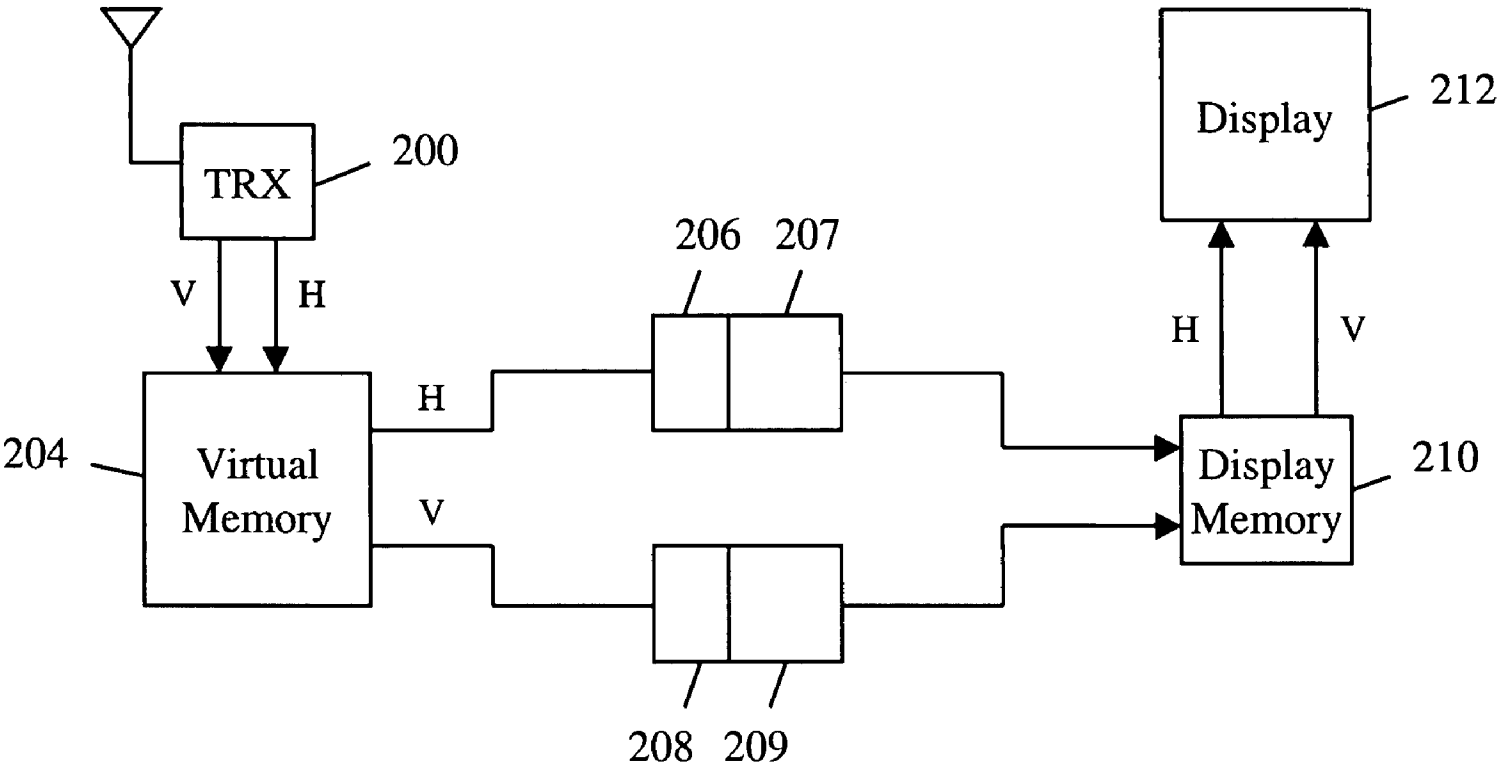
FIG. 2 shows a block diagram of an embodiment of the invention.

FIG. 2 shows a block diagram of the relevant functional components of the wireless handheld device operating in accordance with the present invention. It should be noted that only relevant components to the embodiment are shown for purposes of illustration. The downloading procedure of an exemplary page from a Web server via the radio link 102 is performed according to the operation as described in FIG. 1. At the device end, the Web page is received by transceiver 200 and stored in virtual memory 204 such that the horizontal (H) and vertical (V) pixel information corresponding to the Web page can be read out separately. The virtual memory 204 is sufficiently large enough to hold the entire Web page at once so that to entire page can be viewed by subsequent scrolling. The pixel information is systematically stored by an addressing scheme that is known in the art in which a horizontal pixels and a vertical pixels can be addressed read out separately.

From virtual memory 204, the horizontal pixels are read out and fed to a combination counter 206 and linear low pass filter 207. As the horizontal pixels are read out, they are fed to counter 206 as a horizontal bit stream. The streamed pixels are counted by counter 206 in which every fifth pixel flagged for removal by the low pass filter 207. The remaining horizontal pixels in the stream are fed and stored in display memory 210 which are subsequently sent to the display 212. With every fifth pixel removed, a corresponding reduction in horizontal pixels is 20 percent i.e. from 800 horizontal pixels in virtual memory 204 to the size of 640 horizontal pixels in display memory 210.

Simultaneously, a similar process occurs for the vertical pixels stored in virtual memory 204. As the vertical pixels are read out in a vertical stream, they are fed through counter 208 which flags every third pixel for removal by low pass filter 209. Similarly, the surviving pixels in the stream are stored in display memory 210 i.e. from 450 vertical pixels stored in virtual memory 204 to a 300 vertical pixels in display memory 210. When storage is complete, the resized 640×300 page is fully contained in display memory 210 which properly configured for display on the handheld device.

It should be noted that the invention is applicable for resizing Web pages regardless of how the page is downloaded into the virtual memory i.e. via a wireless radio link or fixed line means.

A major advantage of invention is that the entire Web page is displayed in its entirety on the handheld device. A certain comfort level is gained by the user when viewing familiar Web pages since the proportions will be similar to what he is accustomed to seeing on a PC. Although the displayed page appears somewhat compressed, it is acceptably readable with relatively little geometric distortion. If the fonts are small resulting in poor readability, the user is able to zoom on any part of the screen to improve readability since the original data still remains in virtual memory 204. A noteworthy advantage is that the technique as described resizes both text-based data from HTML pages and embedded images contained in many Web pages. Thus the same proportional decimations are effected equally on e.g. the JPEG and GIF decoded images so they are proportionally resized with the text.

Figure 3:
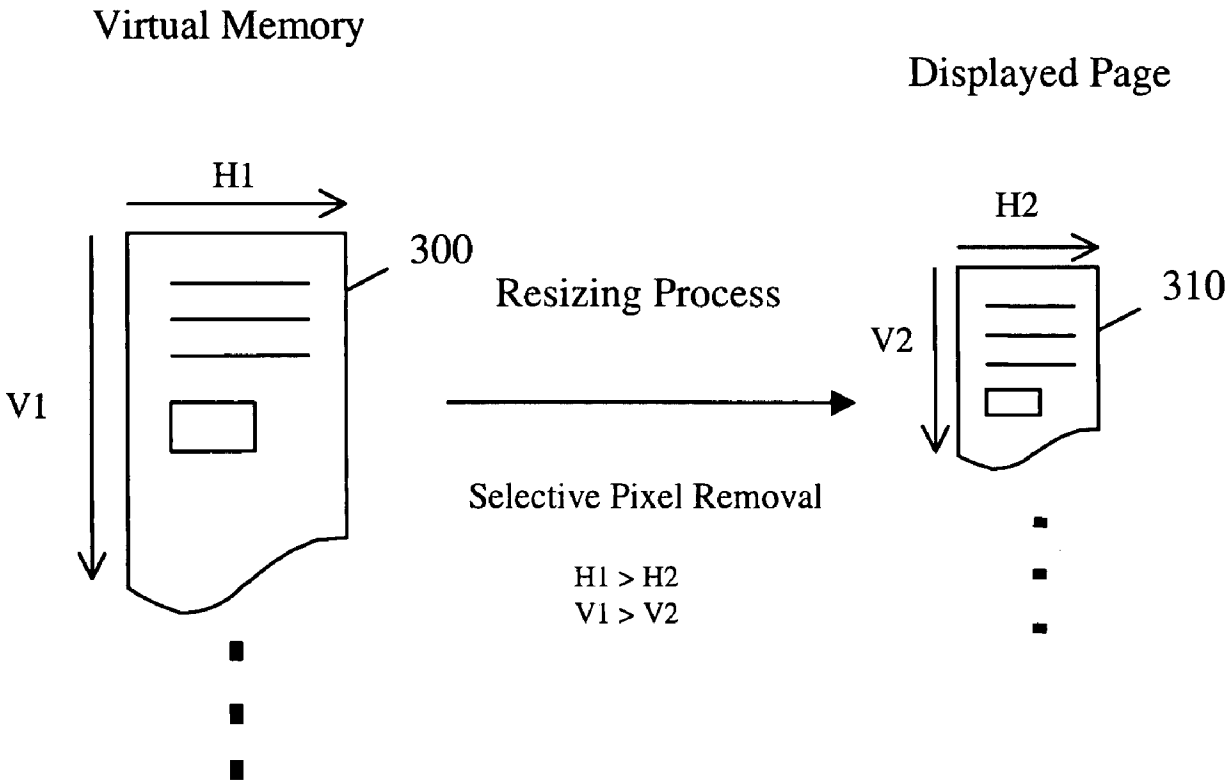
FIG. 3 shows a representation of a Web page resized as a result of the invention.

FIG. 3 shows a representation of a Web page resulting from the resizing process. The originally downloaded Web page 300 is shown as stored in virtual memory 204 having a resolution of H1 and V1 corresponding to 800×450. The resizing process as described in the present invention applies proportional selective pixel removal for both the horizontal and vertical pixels (H2 and V2 respectively) resulting in the 640×300 "compressed" page that is presented on the device display 310. Since the Web page typically continues beyond the bottom of the screen, the user is able to scroll down to view the remaining portions of the page just like on a PC. The invention is particularly applicable to Web pages since they have variable lengths that often require scrolling to view the entire page, which is in contrast to techniques that simply convert the resolution for a fixed set of data i.e. scaling of desktop view as opposed to the contents in a browser window.

The technique of the present invention can be adapted in accordance with the display capabilities of the particular handheld device. By way of example, resizing ratios can be determined from H2/H1 and V2/V1 in which proportional ratios of respective pixels can be obtained by selectively removing them from the bit stream. By way of example, a device having a 600×250 resolution can be achieved by removing every forth pixel in the horizontal bit stream and every second pixel in the vertical bit stream. Other resizing ratios can achieved and adapted as needed to conform to the desired resolution.

Although the invention has been described in some respects with reference to a specified preferred embodiments thereof, variations and modifications will become apparent to those skilled in the art. In particular, the invention is equally applicable to handheld devices downloading Web pages by other means than a wireless connection such as via a fixed line or network connection. It is therefore the intention that the following claims not be given a restrictive interpretation but should be viewed to encompass variations and modifications that are derived from the inventive subject matter disclosed.

The invention claimed is:

1. A method of displaying a resized representation of a markup language based Web page on a handheld device, wherein the handheld device comprises a browser, a virtual memory functionally connected to a horizontal pixel counter and a horizontal pixel filter and to a vertical pixel counter and a vertical pixel filter, a display memory functionally connected to the horizontal pixel filter and to the vertical pixel filter, and a display functionally connected to the display memory, the method comprising the steps of:

loading said Web page into the virtual memory for deriving the resized representation of the Web page;

reading from the virtual memory a bit stream of horizontal pixels and a bit stream of vertical pixels, and feeding the bit streams to the horizontal pixel counter and the vertical pixel counter respectively;

counting the horizontal pixels from the horizontal bit stream with the horizontal pixel counter and removing a portion of the horizontal pixels with the horizontal pixel filter;

counting the vertical pixels from the vertical bit steam with the vertical pixel counter and removing a portion of the vertical pixels with the vertical pixel filter;

storing the remaining horizontal and vertical pixels in the display memory; and displaying the resized representation of the Web page from the display memory.

2. A method according to claim 1 wherein the Web page is loaded over a wireless radio link.

3. A method according to claim 1 wherein the horizontal pixel counter and horizontal pixel filter flags and removes every fifth pixel from the horizontal bit stream.

4. A method according to claim 1 wherein the vertical pixel counter and vertical pixel filter flags and removes every third pixel from the vertical bit stream.

5. A method according to claim 1 wherein the downloaded Web page is stored in the virtual memory in 800×450 resolution.

6. A method according to claim 1 wherein after the compressed Web page is compressed the Web page is stored in the display memory for display in 640×300 resolution.

7. A handheld device comprising a browser for use in loading a markup language based Web page, a display memory, and a device display for viewing a resized representation of the Web page, and the handheld device further comprises:

a virtual memory for storing the loaded Web page comprised of horizontal and vertical pixels, a horizontal pixel counter for counting pixels read from the virtual memory in a horizontal bit stream;

a horizontal pixel filter for removing pixels from the horizontal pixel bit stream;

a vertical pixel counter for counting pixels read from the virtual memory in a vertical bit stream; and a vertical pixel filter for removing pixels from the vertical pixel bit stream, whereby the remaining pixels from the horizontal and vertical bit streams are stored in said display memory for viewing the resized representation of the Web page on the device display.

8. A handheld device according to claim 7 wherein the handheld device is adapted to operate in connection with a wireless telecommunication system in loading said web page.

9. A handheld device according to claim 7 wherein the virtual memory is configured to store an SVGA Web page.

10. A handheld device according to claim 7 wherein display memory is adapted to store a resized 640×300 page.

11. A handheld device according to claim 7 wherein the horizontal and vertical pixel filters are low pass filters.

* * * * *